United States Patent [19]

Van Doren et al.

[11] Patent Number: 4,783,909

[45] Date of Patent: Nov. 15, 1988

[54] REVERSIBLE HEEL COUNTER FOR SHOES

[75] Inventors: Paul J. Van Doren, Corona; Gordon C. Lee, Westminster; Robert E. Diamond, Corona, all of Calif.

[73] Assignee: Van Doren Rubber Co., Inc., Orange, Calif.

[21] Appl. No.: 46,131

[22] Filed: May 4, 1987

[51] Int. Cl.[4] ..... A43B 23/08

[52] U.S. Cl. ..... 36/68; 36/69

[58] Field of Search ..... 36/68, 69, 92, 81, 82, 36/114, 7.1, 32 R; 128/614, 615

[56] References Cited

U.S. PATENT DOCUMENTS

| | | | |
|---|---|---|---|
| 1,174,619 | 3/1916 | Scholl | 36/68 |
| 2,301,836 | 11/1942 | Wilcox | 36/68 |
| 2,994,972 | 8/1961 | Blair | 36/92 |
| 3,425,075 | 2/1969 | Murray | 36/69 |
| 3,824,716 | 7/1974 | DiPaolo | 36/32 R |
| 4,026,044 | 5/1977 | Senter | 36/32 R |
| 4,559,722 | 12/1985 | Norton | 36/69 |

FOREIGN PATENT DOCUMENTS

| | | | |
|---|---|---|---|
| 820710 | 11/1951 | Fed. Rep. of Germany | 36/68 |
| 213740 | 6/1941 | Switzerland | 36/68 |

*Primary Examiner*—Steven N. Meyers

*Attorney, Agent, or Firm*—Knobbe, Martens, Olson & Bear

[57] ABSTRACT

A shoe is provided with a reversible heel counter so the shoe can be selectively used as either a slipper or a regular shoe. An inclined slit is placed in each of the quarters, running from the upper edge toward the lower corner of the quarters adjacent the edge that will be joined to the other quarter. The slit is restitched with a zigzag stitch to form a butt joint which acts like a hinge. The quarters are then joined. A generally parabolic shaped heel counter is fastened over the joint, at the upper edge of the quarters, with the tip of the heel counter depending towards the bottom of the quarters where the insole attaches. The hinge line in each of the quarters adjacent the heel allow the heel counter to be selectively positioned down against an insole of a shoe to be used as a heel seat to form a slipper. When the heel counter is positioned upright in a heel counter position, a regular shoe is provided.

10 Claims, 3 Drawing Sheets

REVERSIBLE HEEL COUNTER FOR SHOES

BACKGROUND OF THE INVENTION

This invention relates generally to the field of footwear, relates specifically to slippers and shoes, and relates in particular to deck shoes. Deck shoes include shoes with a fabric upper, and a rubber outsole, such as tennis shoes, basketball shoes, sneakers and the like.

Conventional footwear includes slippers, which are a low-cut shoe held onto the foot by the upper, which usually consists only of a vamp. They allow a person's foot to be inserted into the throat of the slipper, generally parallel to the sole. A slipper thus engages along the front part of the foot and is not connected to the heel of the foot. The slippers are designed to be put on and taken off easily, but often require a shuffle step to keep them on the foot, and come off easily when running.

Shoes engage not only the toe and instep, but also the heel of a person's foot. Shoes are designed to engage a person's heel so that the back portion of the shoe sole is not free, but moves substantially concurrently with a person's heel. This portion of the shoe is called the heel counter. The shoe is put on by inserting the foot through an expandable throat of the shoe, until the heel counter can be slipped behind the heel of the wearer's foot.

The fit of the shoe can be maintained by laces through eyeholes which allow the throat of the shoe to be expanded so the foot can be inserted into the shoe, whereupon the laces can tighten to adjust the fit of the shoe on the foot. If a slip-on shoe is used, a gore can be used to allow expansion of the throat of the shoe while the foot is inserted, yet maintain the shoe on the foot after the foot is inserted. Whether laces or a gore is used, the heel counter maintains the shoe on the heel of the wearer's foot.

If the heel counter is too stiff or contoured too differently from the heel on the wearer's foot, the wearer's foot will develop blisters. If the heel counter is too flexible, that portion of the shoe will collapse so that the shoe does not maintain adequate contact with the heel of the wearer's foot. This improper contact can lead to blisters, or to a person stepping out of the shoes during walking or running.

Shoes that engage only the front part of a wearer's foot are easy to get on and off, but do not adequately contact and support the heel of the wearer's foot during running or during fast lateral movements. If the wearer begins to lose a shoe during running, it is very easy to actually lose the shoe, fall or twist an ankle. Thus while the slipper type of footwear is easy to put on, it is also easy to take off, intentionally, or inadvertently.

The use of a heel counter on properly fitted shoes can prevent the footwear from coming off inadvertently. However, shoes with a heel counter are time-consuming or awkward to put on and take off. A wearer must bend to tie or untie the laces, or bend to reach the shoe and slip the heel of the foot into the heel counter. Impatient persons, especially children, often try to force the foot into the shoe, collapsing the heel counter.

If the shoe is of cloth construction such as deck shoes, tennis shoes, or sneakers, the heel counter can be stepped on and forced against the insole akin to be used in a manner similar to a slipper. However forcing the heel counter against the insole breaks the heel counter and ruins the shoe. The collapsed heel counter causes the shoe to fit improperly as a slipper and to easily fall off. Further, collapsing the heel counter destroys the strength and rigidity needed to make the shoe fit properly. The importance of maintaining the integrity of the heel counter is shown by the development of the shoehorn, developed to facilitate the insertion of the foot into the shoe without damaging the heel counter.

The time required to put on the shoe or take it off can become unacceptably burdensome in many instances. Japanese customs, for example, often require removing shoes before entering rooms. Workers doing outside work during inclement weather will often remove their shoes before coming inside. If the work activities require constant travel between the inside and outside, the footwear must either be removed and put back on numerous times, or a protective floor covering must be put down.

There is thus a need for a shoe that can be easily put on and taken off when desired, yet not easily fall off the foot when desired. There is a further need for a shoe that can be used as either a slipper engaging the front portion of a foot or, when desired, as a shoe which also engages the heel of the person wearing the shoe.

SUMMARY OF THE INVENTION

Repositionable heel counter means are provided which can be selectively positioned in a heel counter position for use as a heel counter in a shoe, or can be selectively positioned in a heel seat position for use as a slipper. A means is provided to urge the repositionable heel counter to remain in the selected position, and to enter the selected position when the heel counter is a predetermined distance from the selected position. A full gore is preferably provided to maintain the fit of the shoe/slipper, even when laces are provided on the shoe.

This repositioning is achieved by use of a heel counter having a generally parabolic shape, with the flat edge being connected to an upper edge of the quarters, over a juncture of the quarters at the heel. The tip of the heel counter depends toward the insole, but is not fastened to the insole, and preferably terminates spaced apart from the insole. This is contrary to conventional heel design which has the heel counter fastened to the insole, and extending toward the upper edge of the quarters, but terminating spaced apart from the upper edge.

The size and shape of the heel counter of this invention roughly corresponds to, but is preferably smaller than, the portion of the insole against which the heel counter is placed when in the heel seat position. When fastened adjacent the upper edge of the quarters, it has its greatest width adjacent that upper edge. Since the width is preferably not greater than the corresponding width of the insole, it is relatively small compared to the width of heel counters used conventionally, especially those used with deck shoes. Conventional heel designs use heel counters that wrap entirely around the heel of a wearer's foot and extend to the instep of the foot.

Hinges facilitate the positioning of the heel counter into the selected positions. The portion of the quarters in the space between the tip of the heel counter and the insole is flexible relative to the combination of the heel counter and quarter, and thus acts as a hinge.

Additional side hinges are placed in the sides of the quarters, on opposite sides of the heel counter. These latter hinges preferably take the form of hinge lines that extend for at least a portion of the inclined line extending from the upper edge of the quarters, rearwardly and downwardly toward the juncture of the quarters below the insole. This latter point occurs roughly at a longitudinal axis along the center of a bottom of the insole, below the heel counter.

While difficult to describe and measure, when viewed from the side of the shoe, these hinge lines are inclined at an angle of between about 25° to 35°, and preferably 30° with respect to a plane substantially parallel to the insole, and if the shoe is a deck shoe having foxing, which is also substantially parallel to the foxing. Preferably, these hinge lines are located along the upper edge of a fold formed in the quarters by placing the heel counter of this invention against the insole, before these side hinges are inserted. A cut, restitched with a merrow stitch, has been found suitable for the line hinges.

The heel counter is located between these side hinge lines, and above the hinge in the quarters below the heel counter. These line hinges, and the hinge below the heel counter, can cooperate to effectively form a continuous, curved hinge which effectively encloses the heel counter.

The area between the heel counter and the hinge lines generally increases from adjacent the insole, toward the upper edge. This area can act as a rolling, overcenter hinge to urge the heel counter into one of the selected positions, and to maintain the heel counter in the selected position. The hinge area below the heel counter can also act in a similar overcenter hinge manner.

The assembly of the shoes of this invention requires different steps be performed on the quarters, and a different sequence. The quarters are cut along at least a portion of a predetermined line extending from the upper edge of the quarters, toward the lower edge, adjacent the portion that will be joined to another quarter to form a heel for a shoe. Preferably the cut does not extend all the way to the lower edge. This line has an inclination of between 47° to 57°, and preferably about 52°, with respect to a substantially vertical line placed along the location of the juncture at which two quarters will be joined to form a heel for a shoe.

The cut is then restitched with a merrow stitch to form a hinge line. Two such quarters are then joined in a butt joint with a backside stay. The stitching joining the backside stay preferably crosses the cut and restitched joint to prevent the merrow stitch from unraveling. A binding is then placed on the upper edge of the joined quarters. Preferably the binding also overlaps with one end of the restitched cut so as to prevent unraveling of the merrow stitch.

Eyelets and laces can then be added if desired. Even if eyelets and laces are used, a full gore is also used to join the quarters adjacent the eyelets.

There is thus advantageously provided a shoe having a heel counter which can be selectively placed in a heel counter position for use as a shoe, or placed in a heel seat position for use as a slipper.

BRIEF DESCRIPTION OF THE DRAWINGS

The features of the present invention will be more readily appreciated by reference to the following detailed description of a preferred embodiment considered in connection with the accompanying drawings, in which reference symbols designate like parts throughout the figures.

DESCRIPTION OF THE PREFERRED EMBODIMENT

Figure 1:
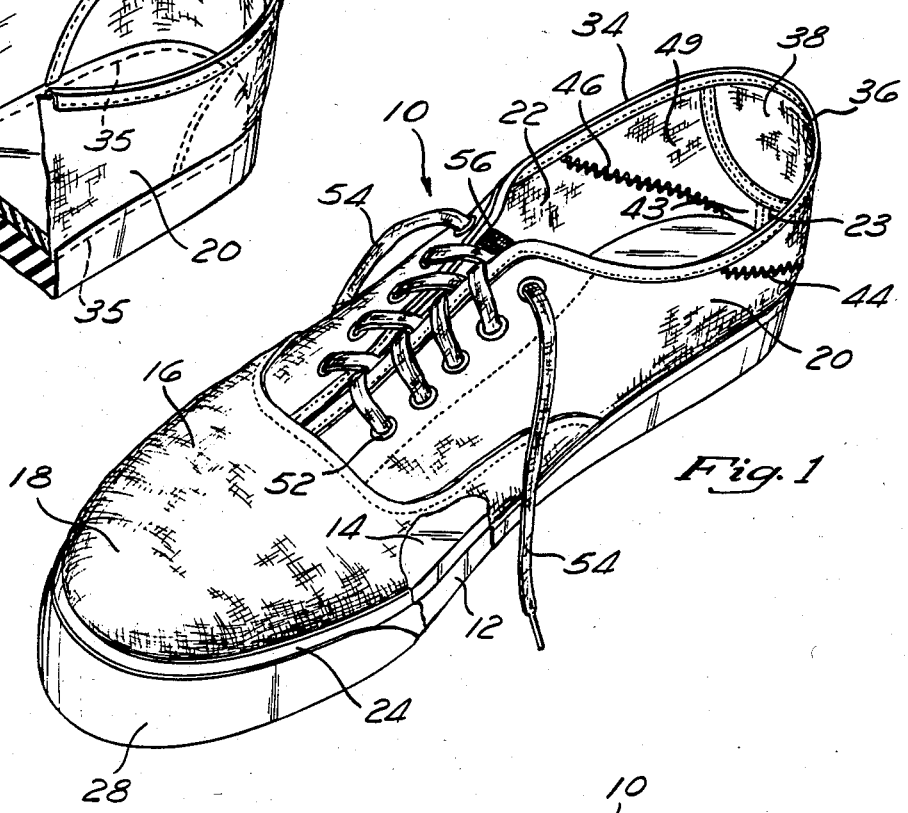
FIG. 1 is a front, perspective view showing a laced shoe of the invention.

Referring to FIG. 1, there is shown a shoe 10, which will be described with reference to a deck shoe. Shoe 10 has an outsole 12 generally shaped to correspond to the shape of a wearer's foot. An insole 14 has a shape corresponding to the outsole 12, and is fastened to the outsole 12. An upper 16 comprises a vamp 18 which is connected to inside quarter 20 and outside quarter 22, with the terms "inside" and "outside" denoting whether the particular quarter 20 or 22 is located on the inside or outside of a foot inserted into the shoe 10.

While it is possible to make them out of one continuous piece of material, the quarters 20 and 22 are typically two separate pieces that are joined together at the heel of the shoe 10 along a generally vertical line or seam referred to as juncture 23. An outside back stay 25 is fastened to the exterior side of the joined quarters 20 and 22 over the juncture 23 to hold the abutting ends of quarters 20 and 22 together.

Since the particular shoe described in the preferred embodiment is a deck shoe, the upper 16 is adhered to the insole 14 by a strip of foxing 24 which comprises a strip of rubber. The outsole 12 is connected to the upper 16 by a strip of cloth impregnated with rubber, such as friction 26. A toe bumper 28 overlaps the foxing 24 and friction 26 at the toe of the shoe 10.

Figure 3:
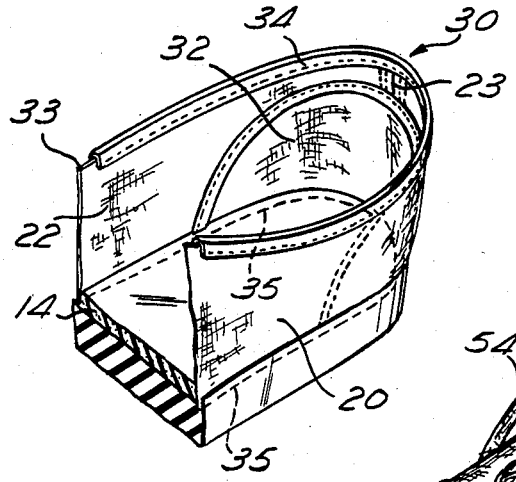
Fig. 3 (PRIOR ART)
FIG. 3 is a front perspective view of the heel portion of a conventional shoe.

Referring to FIG. 3, there is shown a heel 30 of a conventional shoe. A heel counter 32 is located inside of the shoe and is fastened to the inside and outside quarters 20 and 22, and to the insole 14. When laid flat, the conventional heel counter 32 has a generally semicircular shape, with the straight edge being the edge connected to the insole 14. The conventional heel counter 32 connects to the insole 14 around a substantial portion of the heel 30, and curves up from both sides of the insole 14 toward the juncture 23 between the quarters 20 and 22. A collar or binding 34 covers the upper edge 33 of quarters 20 and 22. In the conventional shoe, the heel counter 32 extends from adjacent a lower edge 35 of quarters 20 and 22, toward the upper edge 33 and binding 34, but ends before reaching the binding 34. The termination of the heel counter spaced apart from the binding 34 is especially common with deck shoes.

Referring to FIGS. 1, 2, 4, 6–7, the heel 36 of the present invention has a heel counter 38 that is shaped differently, and attached differently than is the conventional heel counter 32 (FIG. 3). The heel counter 38 has a shape that roughly corresponds to, but is slightly smaller than, that portion of the insole 14 which is adjacent the heel counter 38 when the heel counter 38 is pressed against the insole 14.

Figure 5:
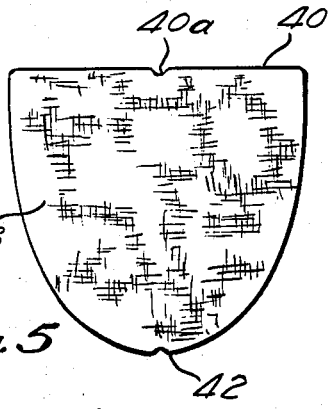
FIG. 5 is a plan view of a heel counter of this invention.

Described in more detail, the heel counter 38 has a somewhat parabolic shape when taken in plan view as shown best in FIG. 5. The heel counter 38 has a flat edge 40 representing a chord across the generally parabolic shape, and a tip 42 at the end of the curved portion of the parabola. The heel counter 38 is centered on the juncture 23 formed by abutting ends of the quarters 20 and 22, so that the center 40a of the flat edge 40 lies on the juncture 23 of those two quarters.

The flat edge 40 is covered by and bound by the binding 34, the tip 42 is oriented toward the insole 14. The heel counter 38 thus has its greatest width adjacent the upper edge 33, with its tip 42 orientated toward, but not extending far enough to connect to, the insole 14. The curved edge of the heel counter 38 thus extends from the binding 34 toward the insole 14, which is just the opposite of conventionally designed heel counters 32, as shown in FIG. 3.

Figure 7:
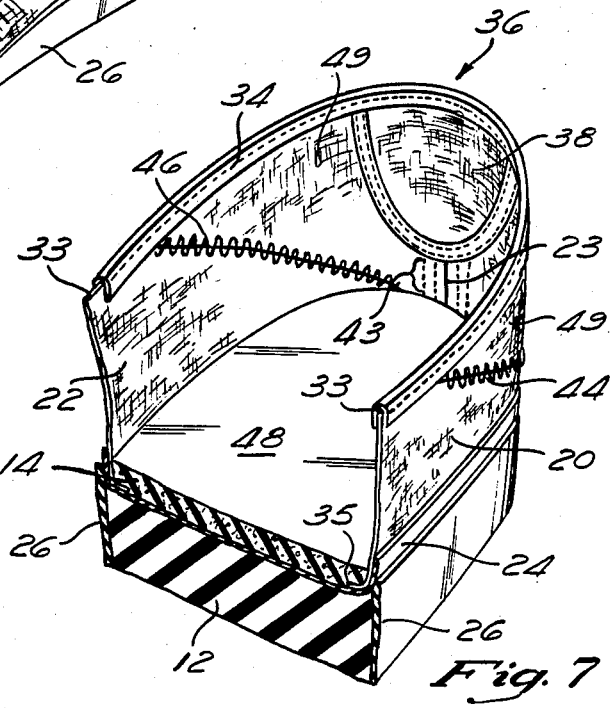
FIG. 7 is a front perspective view showing the heel portion of the present invention.

Referring to FIG. 7, the heel counter 38 is not fastened to the insole 14 as with conventional heel counters 32 (FIG. 3). Preferably heel counter 38 terminates before reaching the insole 14, so a space forming an area 43 on the quarters 20 and 22 is formed between the tip 42 and the insole 14. The heel counter 38 is made out of a material that is preferably stiffer than the quarters 20 and 22. The attachment of the heel counter 38 to the quarters 20 and 22 also stiffens the immediate area at the heel counter 38.

Thus, the area 43 will bend before the heel counter 38 will bend. The result is that the area 43 acts as a hinge to allow rotation of heel counter 38 about a hinge line 45 (FIG. 9) that is in a plane substantially parallel to the insole 14, and passing through quarters 20 and 22 at the area 43. This hinging ability is very pronounced with deck shoes where the quarters 20 and 22 are made of fabric, and the heel counters 38 are made of significantly stiffer materials.

As shown in FIG. 3, the conventionally designed heel 30 has a heel counter 32 with a significantly longer flat edge, which is fastened to the insole 14 around a substantial portion of the heel, and terminates before reaching the upper edge 33 of quarters 20 and 22. Further, the heel counter 32 does not connect to the upper edge 33.

Referring again to FIGS. 1, 2, 4, 6, 7, and 9, there are, in accordance with the invention, correspondingly shaped hinge lines 44 and 46 on inside and outside quarters 20 and 22, respectively. The hinge lines 44 and 46 are on opposite sides of heel counter 38. The hinge lines 44 and 46 have one end covered by the binding 34. From a plan view showing the side of the shoe 10, the hinge lines 44 and 46 run in a generally straight line toward the rearmost, center portion of insole 14. Alternately phrased, the hinge lines 44 and 46 run from the upper edge 33 of quarters 20 and 22, toward the lower edge 35, adjacent the juncture of the quarters 20 and 22.

The hinge lines 44 and 46 are connected to the insole 14 by foxing 24. The hinge lines 44 and 46 do not extend all the way to the abutting ends of the quarters 20 and 22. The hinge lines 44 and 46 are located, and generally take the shape of the fold formed by the quarters 20 and 22 when the heel counter 38 is positioned against the insole 14. The orientation of the hinge lines 44 and 46 are described in further detail in the section dealing with how the heels 36 are assembled.

Preferably, the hinge lines 44 and 46 are formed by cutting or slitting the quarters 20 and 22, and then restitching them to form a butt seam that allows rotation of the quarters 20 and 22 about the cut or slit. A stitching found suitable for this use is diversely called a merrow stitch, a butt stitch or a zigzag stitch. Preferably, the stitching should be as close to the cut edges of the hinges 44 and 46 as possible, while not being so close as to rip through the quarters 20 and 22. A spacing about 5/16 inch between holes on opposite sides of the hinge 44 and 46 has been found suitable. Ten to twelve threads per inch are preferred for this merrow stitch, which is far greater than the 6–8 threads per inch normally used for a merrow stitch.

The butt joint, combined with the marrow stitch, allows the portion of the quarters 20 and 22 on the side of the cut adjacent the back counter 38, to rotate about hinge lines 44 and 46 without substantially flexing the portion of the quarters 20 and 22 on the opposing side of the cut. Thus, the marrow stitching acts as a line hinge allowing that portion of the quarters on each side of the cut to rotate independently.

Figure 2:
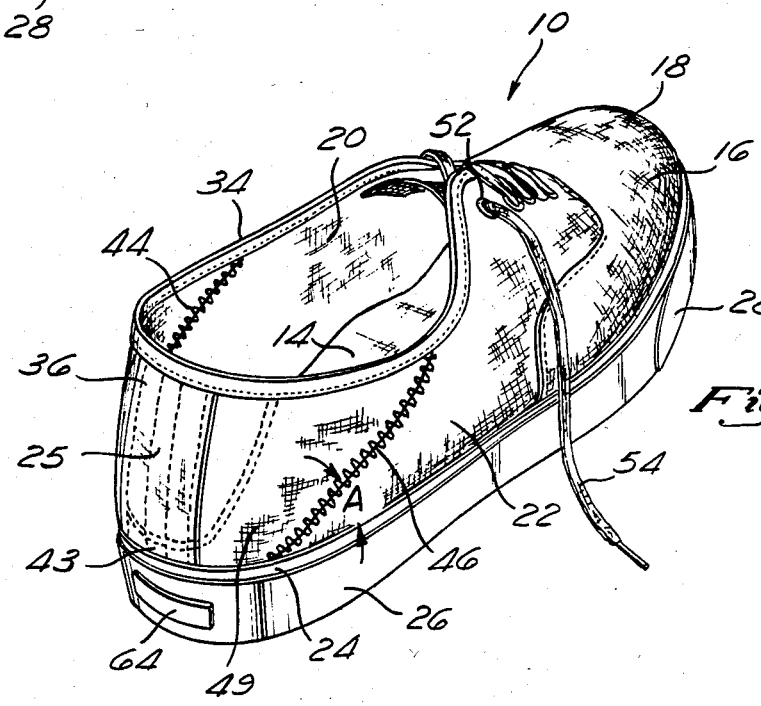
FIG. 2 is a rear perspective view showing a shoe of this invention.
Figure 6:
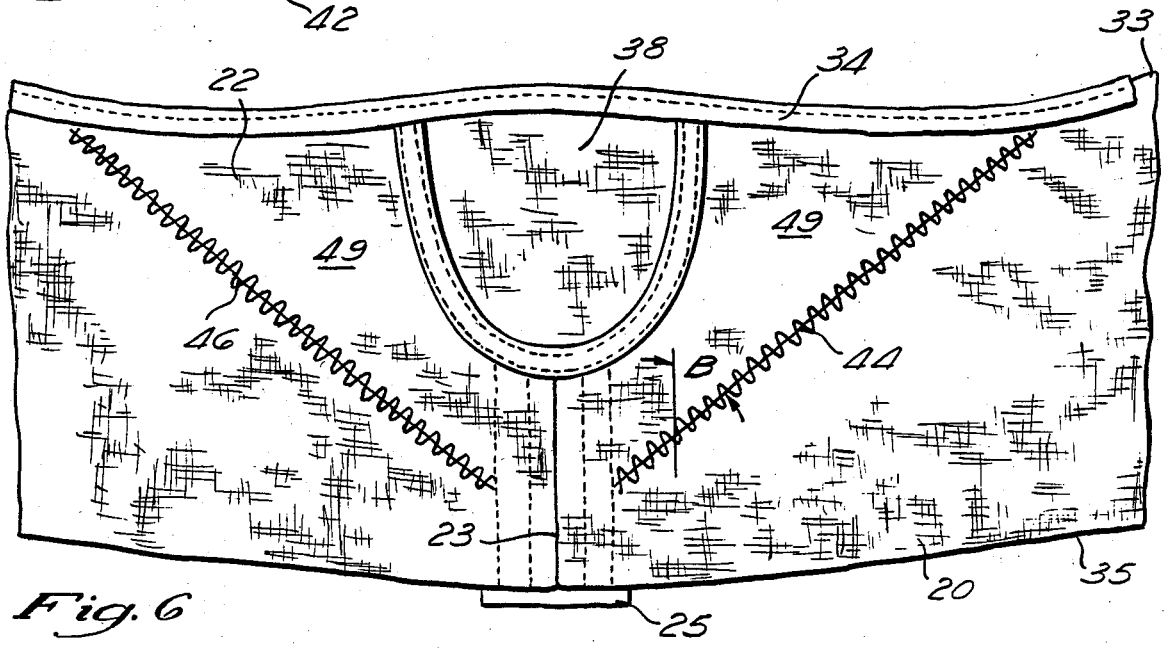
FIG. 6 is a plan view of two joined quarters and a heel counter, and hinge lines, of this invention.

As seen best in FIGS. 1, 2, and 6, the shape of the heel counter 38, and the orientation of the hinge lines 44 and 46 is such that there is an area 49 between the heel counter 38 and the adjacent hinge line 44 or 46, on each quarter 20 and 22. The distance between the heel counter 38 and the adjacent hinges 44 and 46 generally increases from the insole 14 toward the upper edge 33. Again, the quarters 20 and 22 are of a material that is much less stiff than the heel counter 38, especially for deck shoes where cloth is used for the quarters 20 and 22. Thus the area 49 is flexible relative to the heel counter 38.

The functioning of the heel 36 will now be described with reference to FIGS. 1, 4, 7, and 9. The heel 36 can be used to change the shoe 10 from a slipper into a regular shoe. The heel counter 38 is moved toward the insole 14 so that it lies against a heel seat 48 (FIG. 9) of insole 14. The quarters 20 and 22 hinge along predetermined hinge lines 44 and 46, respectively. The area 43 between the tip 42 and insole 14 also acts as a hinge to facilitate repositioning of the heel counter 38 by rotation about line 45.

The hinges allow the heel counter 38 to be repositioned from an upright orientation substantially perpendicular to the insole 14, for use as a shoe, into a position adjacent and substantially parallel to the heel seat 48 and insole 14 (FIG. 9), for use as a slipper.

Figure 9:
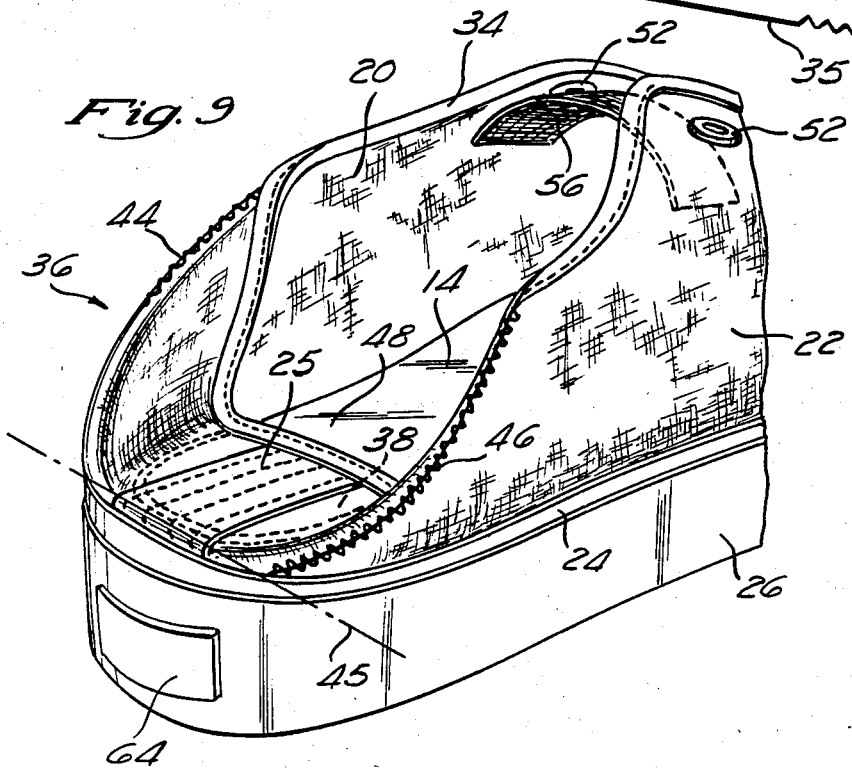
FIG. 9 is a rear, perspective view of a shoe of this invention with the heel counter in a heel seat position.

When the heel counter 38 is positioned against the insole 14, as in FIG. 9, the heel counter 38 effectively acts as a heel seat, and this position is referred to as the heel seat position. When the heel counter 38 is in the upright position, as in FIGS. 1 and 4, it can be used as a heel counter, and this position is referred to as the heel counter position.

Thus the heel counter 38 can be releasably repositioned to be used as a heel seat or as a heel counter. The heel counter 38 can be positioned to form a shoe which engages a wearer's heel, or it can be positioned to form a slipper allowing the easy insertion of a wearer's foot without engaging the heel of the wearer's foot. Viewed slightly differently, the heel 36 is designed to be reversible such that it can be positioned in a heel counter position to form a shoe which engages a wearer's heel, or it can be positioned in a heel seat position to form a slipper allowing the easy insertion of a wearer's foot without engaging the heel of the wearer's foot.

The configuration and stiffness of the heel counter 38 when attached to the quarters 20 and 22, the relative flexibility of the quarters 20 and 22, and the location and hinge affect of the hinge lines 44 and 46 also affect how well the shoe 10 fits when used as a regular shoe or when configured to be used as a slipper. If the heel counter 38 extends so far toward lower edge 35 so as to connect to the insole 14, the heel counter 38 will not fold down well, and will cause the quarters 20 and 22 to flair out and not contact any portion of the wearer's foot, thus causing a very poor fit.

This aspect is most readily seen if a conventional heel 30, as shown in FIG. 3, is taken with the wearer just stepping on the heel 30 to force it against the insole 14. The heel counter 32 resists bending and causes "winging" or excessive flair-out of the quarters 20 and 22. The conventional heel 30 is not designed to flex in this manner, and even if the heel counter 32 is flexible enough to bend without breaking, it will lose its rigidity and shape, and will not sufficiently support the heel of the wearer's foot when the shoe is used as a regular shoe. Further, the flairing-out causes a poor fit so that the shoe does not even work well as a slipper, and causes the wearer to grip the shoe with the toes of the foot in order to keep the it from falling off.

Thus, a conventional heel 30 is not designed to enable a shoe to function as both a shoe and as a slipper, and cannot be used as both. If such use is attempted, the integrity of the heel counter 32 is destroyed so that the shoe does not function well as either a shoe or a slipper. Referring to FIGS. 1, 4, 6, and 9, if the inclination of the hinge lines 44 and 46 with respect to insole 14 is too great or too perpendicular, the shoe does not hold onto the wearer's foot as well as if the cut were more inclined. It is believed preferable that the hinge lines 44 and 46 fall along the upper edge of a fold formed in the quarters 20 and 22, respectively, when there is no hinge 44 and 46 but when the heel counter 38 is placed against the insole 14, as in FIG. 9.

Defining the location and orientation of this hinge line is difficult on an assembled shoe as the quarters 20 and 22 are typically curved and have no straight lines, nor any completely vertical or completely horizontal lines. The location and orientation of the hinge lines 44 and 46 may be generally described with reference to a longitudinal axis running along the center of a bottom surface of insole 14. The hinge lines 44 and 46 are located along at least a portion of a line extending from the upper edge 33 toward the portion of this longitudinal axis which is below the heel counter 38.

Referring to FIG. 2, another way of describing the orientation is that if the foxing 24 is placed in a substantially horizontal position, an angle "A" in the range of 25° to 35° with respect to the horizontal plane, or about 65° to 55° with respect to the vertical plane, is believed suitable for hinge lines 44 and 46. Preferably, the angle is about 30° from the horizontal, or 60° from the vertical plane as those planes are described above. If the foxing 24 is assumed to be substantially parallel with the insole 14, then these angles would be with respect to the insole 14. Again, however, the exact angle is difficult to determine because of the curved nature of the quarters 20 and 22 and the construction of the shoes 10.

The shape of the the heel counter 38 is shown in FIG. 5. The size of the heel counter 38 found suitable for deck shoes of sizes 9–13 has a flat edge 40 with a length of about two inches with the distance from the center **40*a* of flat edge 40 to the tip 42 also being about two inches. The heel counter 38** is made out of the same material as conventional heel counters, such as rag compound to a duck boot having a thickness of 0.07 to 0.08 inch, including the boot duck cloth.

If the heel counter 38 is too large, it will not lay sufficiently flat in a heel seat position adjacent the insole 14, and will not pop down but will rather resist bending into the heel seat position. The same result occurs if the heel counter 38 is made too wide. If the heel counter 38 is made generally smaller, the heel 36 will move into the heel seat position adequately, but it will not reverse into the upright or heel counter position well, nor will it fit the heel of the wearer's foot as well. A similar result occurs if the heel counter 38 is made too narrow. Further, if too narrow, the heel counter 38 will not wrap around the heel of the wearer's foot and thus will not adequately support or fit the heel of the wearer's foot when in the upright position, or heel counter position, for use as a shoe.

If the heel counter 38 is made shorter such that the distance between the flat edge 40 the tip 42 is smaller, the heel counter 38 becomes more collapsible, loses its rigidity, does not stay up on a foot as well when in the upright, or heel counter position. If made sufficiently small or if it lacks sufficient stiffness, it will collapse like a "sock on a rooster." If the heel counter 38 is made too long, it will not move into the heel seat position, nor will it lay sufficiently flat.

The configuration of the heel 36 also helps position the heel counter 38 in its two selectable positions for use as a heel seat, or as a heel counter. Moving the heel counter 38 from the heel counter position toward the insole 14 causes the area 49 of quarters 20 and 22 to bend and roll down, somewhat like a rolling hinge action, but the rolling appears to stop at the hinge lines 44 and 46. This rolling action inhibits movement of the heel counter 38 from the heel counter position. After the heel counter 38 has moved close enough to the insole 14, the flexibility of area 49 of quarters 44 and 46 appears to urge the heal counter against the insole 14 and into the heel seat position. The area 49 further appears to resist or inhibit movement of the heel counter 38 out of the heel seat position.

Similarly, after the heel counter 38 is moved a certain distance away from the insole 14 from the heel seat position, the area 49 also appears to urge the heel counter 38 into the heel counter position.

Since the quarters 20 and 22 are flexible relative to the heel counter 38, the heel counter 38 does not substantially bend during this repositioning.

Referring to FIG. 7, the heel counter 38 is not connected to the insole 14, and does not extend sufficiently far to be connected to the insole 14. Preferably, the tip 42 of the heel counter 38 does not extend past the top of the foxing 24. Since the construction of the deck shoes 10 is such that the top of the foxing 24 is slightly above the insole 14, there is always a slight ridge when the heel 36 is popped down against the insole 14, into the heel seat position. This slight offset is believed to be advantageous in that it provides some support to the periphery of the heel of the wearer's foot and helps maintain the slipper on the foot.

As previously mentioned, the flexibility of the area 43 of the quarters 20 and 22 located between the tip 42 and the insole 14 acts as a hinge to facilitate the repositioning of the heel 36. It is further believed that the location and flexibility of area 43 acts as a positioning device which maintains the heel 36 in the pop down, slipper configuration, or the popped up, shoe configuration. It is also possible that the hinge lines 44 and 46 can join hinge line 45, to form a continuous, but curved hinge line which allows repositioning of heel counter 38 between the heel counter position and the heel seat position. The continuity of such a hinge line is seen best in FIG. 9.

The slight offset between the tip 42 and the insole 14 and the flexibility of the quarters between the tip 42 and the insole 14, which, when combined with the relative rigidity of the heel counter 38, is believed to act as an overcenter hinge such that the heel counter 38 pops down and remains in the heel seat position, and will not pop up until moved past the offset, and once past that offset, will tend to continue moving up of its own accord into the heel counter position for use as a shoe to support the heel of the wearer's foot.

Thus, the location and relative rigidity of the heel counter 38, is also believed to cooperate with relative flexibility of the quarters 20 and 22, to form an overcenter hinge. Moving the heel counter 38 a predetermined distance toward the heel counter position will urge the heel counter 38 into that position and help maintain that position. Moving the heel counter 38 a predetermined distance toward the insole 14, will urge the heel counter 38 into the heel seat position and will help maintain that position. The predetermined hinge lines in the quarters 20 and 22, are also believed to cooperate with this overcenter hinge aspect as previously described.

There is thus advantageously provided a heel design which supports the wearer's foot when used as a shoe, but which can be reconfigured to form a slipper which also adequately supports the foot. There is advantageously provided a heel counter which can be reversibly used as a heel counter or as a heel seat.

Figure 4:
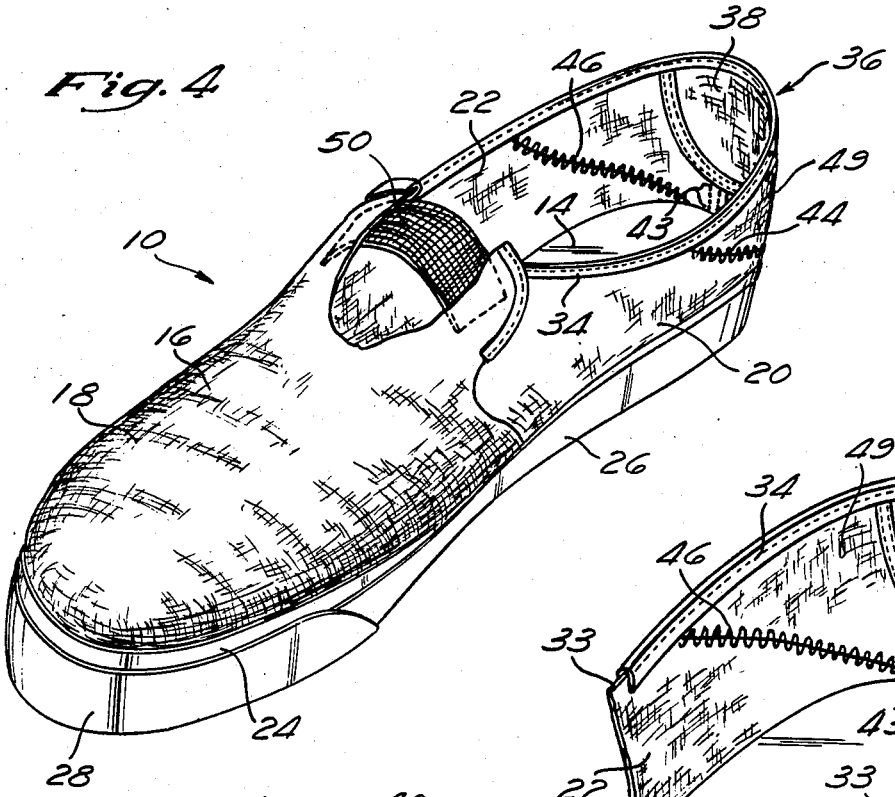
FIG. 4 is a front perspective view of a slip on shoe of this invention.

Referring to FIG. 4 for slip-on shoes it is not uncommon to have a gore 50 connecting the front portion of quarters 20 and 22, in order to allow the throat of the shoe 10 to expand for insertion of the wearer's foot. The gore 50 generally comprises an elastic member which maintains the fit of the shoe on the wearer's foot. The pop-up heel 36 of the present invention is not limited to use with slip-on type shoes. Referring to FIGS. 1, 2, and 9, there is shown a novel shoe 10 having eyelets 52 through which laces 54 are inserted to fasten the shoe to the wearer's foot. However, in addition to, and preferably instead of a tongue, there is a full gore 56 connecting the quarters 20 and 22. The full gore 56 maintains the shoe 10 on the wearer's foot when a shoe 10 is configured to be used as a slipper. The laces 54 can be decorative, but preferably can be used to adjust the tightness of the shoe on the foot. In activities requiring lateral movement, the laces 54 can provide advantages over the slip-on style of shoe.

The unusual shape and construction of the heel 36 of the present invention requires an assembly method which is different from present techniques. Referring to FIG. 3, the normal construction of a deck shoe requires joining the quarters 20 and 22 by butting the ends together to form juncture 23, and joining them by use of an outside back stay 25 (see FIG. 2). Typically four seams are used to accomplish this joint. The binding 34 is then placed on the upper edges 33 (FIG. 6) of the now joined quarters 20 and 22. The heel counter 32, is then fastened to the now joined quarters 20 and 22, with the straight edge of the heel counter 32 being adjacent, and substantially parallel to the lower edge 35 of quarters 20 and 22. The heel counter 32 is centered on the juncture 23 of the quarters 20 and 22. The free ends of the quarters 20 and 22 are then either joined by a gore 50 if the shoe 10 is a slip-on, or, if laces are to be used, or provided with eyelets 52 (FIG. 1) and then joined to a tongue. The joined quarters 20 and 22 are then connected to the vamp 18, and subsequently to the insole 14 and outsole 12.

Referring to FIG. 6, in the shoe of the present invention, each of the quarters 20 and 22 are provided with a hinge line 44 and 46, respectively, before they are joined. As shown, a portion of the quarters 20 and 22 have been cut, stitched, the heel counter 38 attached, and the binding 34 attached. The view of FIG. 6 is taken in plan view, with the upper edge 33 in a substantially horizontal orientation. When thus viewed, the hinge lines 44 and 46 extend from the upper edge 33 toward the lower edge 35, at the juncture 23 of the quarters 20 and 22. When thus viewed, the joint line of juncture 23 is substantially vertical, and the hinge lines 44 and 46 are inclined at an angle "B" of between 47° to 57° from the vertical, or 33° to 43° from the horizontal. The preferred angle is believed to be about 38° from the horizontal, or 52° from the vertical. The exact angles are difficult to determine because of the curved nature of the joined quarters 20 and 22.

Figure 8:
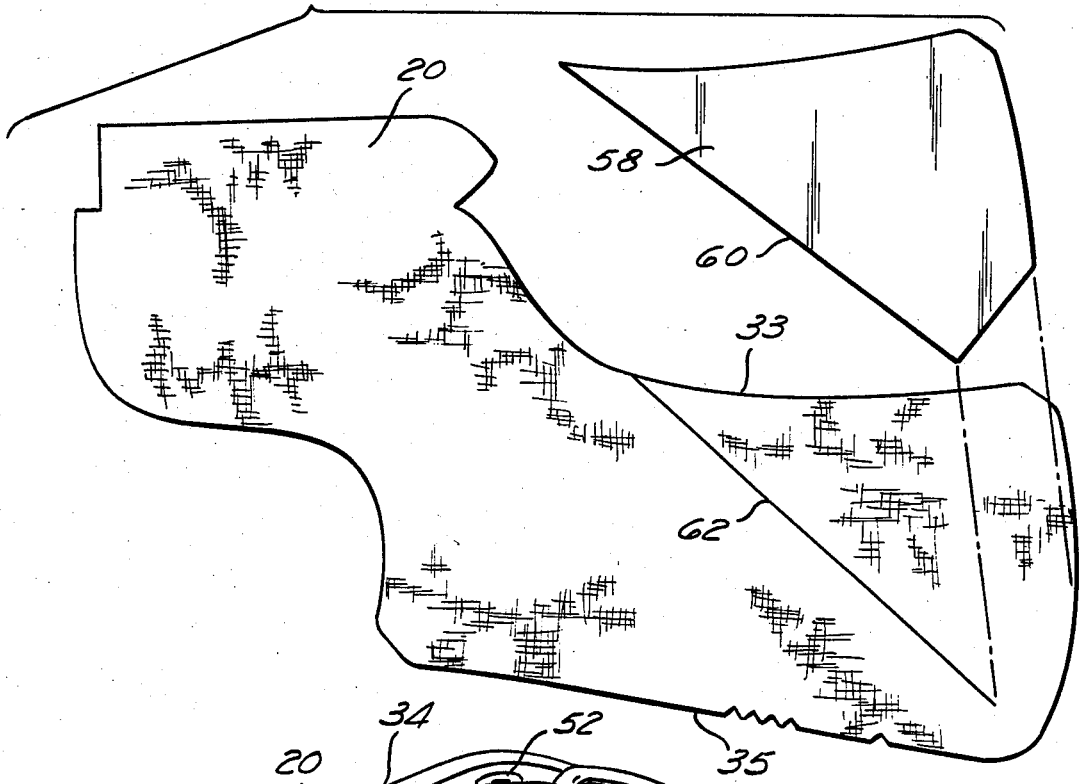
FIG. 8 is an exploded, plan view of a quarter, and a marker of this invention.

Referring to FIGS. 7 and 8, there is shown a typical quarter 20 or 22. Since the procedure is the same, the procedure will be described with respect to inside quarter 20, as if the shoe were being assembled by hand.

A hinge is placed in the quarters. This hinge is preferably achieved by cutting the quarters at a predetermined location. This cut can be performed by hand as follows. A marker 58 is placed on the interior side of inside quarter 20. The marker 58 is a piece of stiff material, such as plastic, having three edges cut to correspond to the shape of the edges of the quarter 20 which will form the upper heel portion or heel counter portion of the shoe 10. The marker 58 has a straight, marking edge 60 which is approximately 4.25 inches long for a shoe of size 9–13. When the marker 58 is placed on the quarter 20, and the edges of marker 58 aligned with the edges of counter 20, then the marking edge 60 is correctly positioned to indicate the length and location of hinge line 44. Preferably, the hinge line 44 runs from the upper edge 33 toward the lower edge 35 and corner of the quarter 20 that will form juncture 23 (FIGS. 6 and 7).

A mark 62 is then made on the quarter 20 corresponding to the marking edge 60. The marker 58 is then removed, and a cut is made along the mark 62. Note that preferably, the mark 62 does not completely separate the quarter 20 into two parts, but preferably leaves them attached. The cut is then restitched to form a hinge line. A zigzag stitch, as previously described, is used to join the cut portions of quarter 20 so as to form a butt joint which acts as a hinge. There is thus provided a means of placing hinge lines 44 and 46 at predetermined locations in the quarters 20 and 22, and thus in the shoe 10.

After the quarters 20 and 22 are cut and rejoined to form hinge lines 44 and 46, the quarters 20 and 22 are joined in the normal manner, typically by use of a butt joint and outside back stay 25. Preferably, however, the stitches on the back stay 25 overlap with the stitching forming hinge lines 44 and 46 to prevent unraveling of the stitching.

The heel counter 38 is then positioned between the hinge lines 44 and 46, so its straight side 40 is adjacent the upper edge 33 of quarters 20 and 22, and the tip 42 is toward the lower edge 35. Alternately phrased, the heel counter 38 depends downward from the upper edge 33 toward the lower edge 35 of the quarters 20 and 22. The heel counter 38 is then attached to the inside of the joined quarters 20 and 22. The attachment is done by use of a piece of cloth tape and double stitches known in the art and not described in detail herein.

Joining the heel counter 38 at the upper edge 33 of the quarters 20 and 24, with the tip 42 extending toward the lower portion of the quarters 20 and 24 which will be joined to the insole 14, is opposite the normal practice. Thus, the heel counter 38 is positioned in an orientation opposite to that used with conventional assembly methods, and is further attached to the upper edge of the quarters 20 and 22, which is opposite the conventional methods.

The binding 34 is then placed on the upper edge 33 of the joined quarters 20 and 22. The binding 34 preferably connects to the cut along mark 62 which extended to the upper edge 33. The binding 34 also covers and connects the flat edge 40 (FIG. 5) of the heel counter 38 to the quarters 20 and 22.

The cut made along the mark 62 is preferably long enough, and the outside back stay 25 is wide enough, such that the outside back stay 25 crosses over the cut along the mark 62. Since the zigzag stitch made along the mark 62 can unravel, the outside back stay 25 serves to fasten the stitch, and stop the unraveling of the stitching from the end of the cut.

Referring to FIG. 4, if the shoe 10 is of a slip-on style, the assembly and construction proceeds in a normal manner, with a gore 50 being connected to the front ends of the quarters 20 and 22, after which the vamp 18 is attached to form an upper 16. The upper 16 is then connected to the insole 14 by use of foxing 24. The outsole 12 is then connected by use of friction 26. Finally, toe bumper 28 is attached and, if desired, a heel label 64 (FIG. 2) is placed on the friction 26 at the heel of the shoe.

Referring to FIGS. 1, 2, and 9, if the shoe 10 of this invention is to contain laces, the procedure to complete the shoe is different after the attachment of the binding 34. At that point, the eyelets 52 are formed in the front edge of the quarters 20 and 22. A full gore 56 is then connected to opposing sides of the quarters 20 and 22 in order to join those quarters. Preferably, the front portion of the quarters 20 and 22, adjacent the eyelets 52, are stitched together to fix the locations of the eyelet 52 relative to one another. The vamp 18 is then connected, and the remaining steps in assembling the shoe are the same as previously described.

There is thus provided a method by which the heel 36 is assembled by cutting and restitching the quarters 20 and 22 to form hinge lines 44 and 46; joining the quarters 20 and 22, preferably so as to prevent unraveling of the stitching on the hinge lines 44 and 46; placing the heel counter 38 on the joined quarters 20 and 22 so the heel counter 38 depends from the edges of the quarters 20 and 22 that will be exposed; fastening the heel counter 38 to the joined quarters 20 and 22 in the downward orientation and with the flat edge 40 adjacent the edge of the quarters 20 and 22; and binding the heel 36, preferably so as to prevent unraveling of the stitches forming the hinge lines 44 and 46, and preferably so as to bind the flat edge 40 to the quarters 20 and 22.

We claim:

1. A shoe construction, comprising:

a pair of quarters joined to form a heelpiece for the shoe, the quarters having an upper edge, and a lower edge;

a hinge in each of the quarters extending along a line, adjacent the juncture of the quarters, from the upper edge to the lower edge, located at an angle of between 45° to 57° with respect to the line formed by the juncture of the quarters, when viewed in a planar view, the hinge line comprising a cut in the quarters which has been rejoined by a merrow stitch to form a butt joint; and a heel counter fastened to the quarters over the juncture of the two quarters, the heel counter depending from the upper edge of the quarters toward the lower edge, but terminating spaced from the lower edge.

2. A shoe, comprising:

an insole, having a longitudinal axis along the center of a bottom surface of the insole;

two quarters, fastened to the insole at a lower edge of the quarters to form a heel, the quarters also having an upper edge;

a heel counter, fastened to the quarters at the heel to form a stiffened area at the heel counter, the heel counter having a shape smaller than, but at least roughly corresponding to the shape of that portion of the insole which is adjacent the heel counter when the heel counter is used as a heel seat, the heel counter extending from the upper edge for more than half the distance toward the insole, but ending before reaching the insole to form a flexible segment of the quarters between the end of the heel counter and the insole, about which the heel counter can rotate so as to place the heel counter against the insole to be used as a heel seat, wherein at least one of the quarters urges the heel counter to remain in the heel seat position when positioned for use as a heel seat, and to remain in the heel counter position when positioned for use as a heel counter; and a hinge in each of the quarters extending from the upper edge toward the longitudinal axis below the heel counter, the hinge formed by a cut in the quarters which has been rejoined by a merrow stitch, the heel counter being located between the hinges.

3. A shoe, comprising:

an insole having a longitudinal axis along the center of a bottom surface of the insole;

two quarters fastened to the insole at a lower edge of the quarters to form a heel, the quarters having an upper edge;

a heel counter fastened to the quarters at the heel to form a stiffened area at the heel counter, the heel counter having a shape smaller than, but at least roughly corresponding to the shape of that portion of the insole which is adjacent the heel counter when the heel counter is used as a heel seat, the heel counter extending from the upper edge for more than half the distance toward the insole, but ending before reaching the insole to form a flexible segment of the quarters between the end of the heel counter and the insole, about which the heel counter can rotate so as to place the heel counter against the insole to be used as a heel seat, wherein at least one of the quarters urges the heel counter to remain in the heel seat position when positioned for use as a heel seat, and to remain in the heel counter position when positioned for use as a heel counter; and a hinge in each of the quarters extending from the upper edge toward the longitudinal axis below the heel counter, each hinge having a hinge line formed by a cut in the quarters, made out of fabric suitable for use with deck shoes, which has been rejoined by a merrow stitch, the heel counter being located between the hinges.

4. A shoe, comprising:

an insole, having a longitudinal axis along the center of a bottom surface of the insole;

two quarters, fastened to the insole at a lower edge of the quarters to form a heel, the quarters also having an upper edge;

a heel counter, fastened to the quarters at the heel to form a stiffened area at the heel counter, the heel counter having a shape smaller than, but at least roughly corresponding to the shape of that portion of the insole which is adjacent the heel counter when the heel counter is used as a heel seat, the heel counter extending from the upper edge for more than half the distance toward the insole, but ending before reaching the insole to form a flexible segment of the quarters between the end of the heel counter and the insole, about which the heel counter can rotate so as to place the heel counter against the insole to be used as a heel seat, wherein the flexible segment urges the heel counter to remain in the heel seat position when positioned for use as a heel seat, and to remain in the heel counter position when positioned for use as a heel counter; and a hinge in each of the quarters extending from the upper edge toward the longitudinal axis below the heel counter, the hinge comprising a cut in the quarters which has been rejoined by a merrow stitch, the heel counter being located between the hinges.

5. A shoe, comprising:

an insole having a longitudinal axis along the center of a bottom surface of the insole;

two quarters fastened to the insole at a lower edge of the quarters to form a heel, the quarters having an upper edge;

a heel counter fastened to the quarters at the heel to form a stiffened area at the heel counter, the heel counter having a shape smaller than, but at least roughly corresponding to the shape of that portion of the insole which is adjacent the heel counter when the heel counter is used as a heel seat, the heel counter extending from the upper edge for more than half the distance toward the insole, but ending before reaching the insole to form a flexible segment of the quarters between the end of the heel counter and the insole, about which the heel counter can rotate so as to place the heel counter against the insole to be used as a heel seat, wherein the flexible segment urges the heel counter to remain in the heel seat position when positioned for use as a heel seat, and to remain in the heel counter position when positioned for use as a heel counter; and a hinge in each of the quarters extending from the upper edge toward the longitudinal axis below the heel counter, each hinge having a hinge line formed by a cut in the quarters, made out of fabric suitable for use with deck shoes, which has been rejoined by a merrow stitch, the heel counter being located between the hinges.

6. A shoe, comprising:

an insole, having a longitudinal axis along the center of a bottom surface of the insole;

two quarters fastened to the insole to form a heel, the quarters having an upper edge;

a heel counter, connected to the upper edge of the quarters and extending down toward, but not terminating before reaching the insole, for supporting the heel of a wearer's foot in a heel counter position, when positioned for use as a heel counter, and for acting as a heel seat when placed in a heel seat position, adjacent the insole, the heel counter having a width that is greatest adjacent the upper edge;

hinge means, comprising a butt joint fastened together by a merrow stitch, in each of the quarters, for selectively repositioning the heel counter between the heel counter position and the heel seat position; and foxing connecting the quarters to the insole, wherein the hinge means extends from the upper edge of the quarter toward the lower edge of the quarter at a joint line, at an angle of between 25° to 35° with respect to a plane substantially parallel to the foxing.

7. A shoe as defined in claim 6, wherein the angle is about 30°.

8. A method for assembling the quarters of shoes, comprising the steps of:

cutting quarters along at least a portion of a line running from an upper edge of the quarter, toward a lower edge of the quarters adjacent a heel portion of the quarters;

restitching the cut to form hinge lines;

joining the quarters; and fastening a heel counter to the joined quarters with the heel counter depending from the upper edge of the quarters toward the lower edges, but terminating spaced from the lower edge.

9. A method as defined in claim 8, wherein the joining step prevents unraveling of the stitching on the hinge lines; and further comprising the step of:

binding the upper edge of the joined quarters and heel counter, the cutting step forming a cut adjacent the upper edge so the binding step crosses the cut and prevents unraveling of the stitches on the hinge lines.

10. A method as defined in claim 8, further comprising the step of:

placing eyelets in the ends of the joined quarters; and joining the ends of the joined quarters with a full gore located adjacent the eyelets.

* * * * *